US005261142A

United States Patent [19]

Linn et al.

[11] Patent Number: 5,261,142

[45] Date of Patent: Nov. 16, 1993

[54] PAINT ROLLER FRAME

[75] Inventors: Richard A. Linn; Edward J. Goldstein, both of Minneapolis, Minn.

[73] Assignee: Padco Inc., Minneapolis,, Minn.

[21] Appl. No.: 799,947

[22] Filed: Nov. 29, 1991

[51] Int. Cl.[5] ..... B05C 1/08; B25G 1/04

[52] U.S. Cl. ..... 15/145; 15/230.11

[58] Field of Search ..... 15/145, 160, 230.11; 249/19.1

[56] References Cited

U.S. PATENT DOCUMENTS

| | | | |
|---|---|---|---|
| 519,354 | 5/1894 | Sheppard . | |
| 1,784,287 | 12/1930 | Hertzberg | 403/70 |
| 1,832,536 | 11/1931 | Dunn | 403/229 |
| 2,028,122 | 1/1936 | Floreth | 267/73 |
| 2,285,818 | 6/1942 | Kootz | 15/145 |
| 2,496,158 | 1/1950 | Greenleaf | 306/2 |
| 2,684,497 | 7/1954 | Graham | 15/145 |
| 3,380,097 | 4/1968 | Pharris | 15/145 |
| 3,596,304 | 8/1971 | Welt | 15/230.11 |
| 3,745,624 | 7/1973 | Newman | 29/116 R |
| 5,060,995 | 10/1991 | Goldstein | 249/19.1 |

FOREIGN PATENT DOCUMENTS

| | | |
|---|---|---|
| 528058 | 3/1956 | Canada . |
| 514007 | 10/1930 | Fed. Rep. of Germany . |

*Primary Examiner*—Edward L. Roberts
*Assistant Examiner*—Patrick Brinson
*Attorney, Agent, or Firm*—Jacobson & Johnson

[57] ABSTRACT

A paint roller frame having a wire coil female thread for attaching a plurality of different handles thereto. The wire coil female thread is formed directly in the wire frame that is used to support the roller. The wire coil female thread locks onto the rigid male threads of a handle and onto the handle to prevent accidental loosening and to also permit the user to completely replace the handle of the paint roller. The helical wire coil female thread is made of a resilient metal wire with sufficient rigidity to permits firm but yieldable direct transfer of pressure to the paint roller from a longer extension handle rather than through a permanent handle mounted directly on the wire frame. An extension member on the end of wire coil female thread enables a user to remove a handle from the wire paint roller frame without the use of a tool.

10 Claims, 3 Drawing Sheets

PAINT ROLLER FRAME

FIELD OF THE INVENTION

This invention relates generally to paint roller applicators and more specifically, to improvements in paint roller applicator frames that allow a user to directly connect the paint roller handle to the frame of a paint roller.

BACKGROUND OF THE INVENTION

The concept of paint roller applicators is well known in the art. In general, a paint roller applicator includes a frame with a permanent paint roller handle for the user to grasp the applicator and a rotatable absorbent covering or roller mounted on the end of the frame to permit the user to roll paint on a surface. The frame and permanent paint roller handle are sufficiently rigid so that a user can apply pressure to the permanent paint roller handle to roll the paint onto a surface. Oftentimes a user needs a longer handle on the paint roller in order to paint overhead surfaces. The conventional way to extend the length of the permanent paint roller handle is to insert a second longer handle into a threaded socket located on the end of the permanent paint roller handle. While the insertion of the extension handle into the end of the permanent paint roller handle is convenient it does have disadvantages. For example, the junction between the permanent paint roller handle and the extension handle usually becomes a weak link oftentimes breaking if too much pressure is accidently applied to the extension handle while rolling the paint onto a remote surface. Consequently, the permanent paint roller handles must be made sufficiently strong so as to accommodate forces at both ends of the permanent paint roller handle. Also the placement of the female threads into a socket housing on the end of the permanent paint roller handle provides a large cumbersome end to the permanent paint roller handle that can irritate a users hand since the shape of the permanent paint roller handle does not smoothly conform to the users hand.

The present invention provides an improved one piece paint roller frame formed from a resilient wire. One end of the paint roller frame is formed into an open wire coil having a female thread configuration that allows the user to easily remove or attach a paint roller handle to the paint roller frame, yet provides a firm but yieldable connection between the paint roller handle and the paint roller frame so that pressure on the handle can be applied directly to the paint roller frame rather than through a socket housing in a permanent paint roller handle. In addition the open wire coil female thread of the present invention minimizes the inherent spring effect produced by forming a wire coil from a resilient metal wire. To minimize the spring effect we provide the wire coil female thread with equal or less turns then the rigid male threads it is to be mounted on. The result is that all the individual turns of the wire coil female thread are locked between the roots and crowns of the rigid male threads to limit the freedom of movement of the wire coil. Locking the female threads formed from a resilient wire into the rigid male threads on the handle provides an interlocking firm connection between the frame and the handle that negates the spring effect inherently produced by an open wire coil female thread. Consequently, the resilient aspect of a wire coil female thread formed from a resiliently wire is substantially destroyed by locking the roots and crowns of the wire coil female thread into the roots and crowns of a rigid male thread. However, since the wire coil female thread is restrained from movement only by the rigid male thread, which is located on the inside of the female thread, the connection between the handle and the frame retains a certain amount of resiliency or yieldability. Consequently, if undue pressure is accidently applied to the extension handle the wire coil female threads, which are located on the rigid male threads, can flex slightly outward and away from the rigid male threads in response to the force. The result is that one can distribute the handle forces to the frame and thus minimize the chances of breaking the connection portion between the frame and the handle.

DESCRIPTION OF THE PRIOR ART

U.S. Pat. No. 3,380,097 shows an extension handle for a paint roller applicator with an extension handle that mounts on to the end of the permanent handle on the paint roller.

U.S. Pat. No. 3,745,624 shows an extensible paint roller frame with a female socket in the end of the permanent handle on the paint roller. The female socket receives an extension handle.

U.S. Pat. No. 3,596,304 also shows a permanent handle on the paint roller with a female socket for threading a longer handle onto the end of the permanent handle.

U.S. Pat. No. 1,784,287 shows a closed helical coil spring for providing a resilient connection between the mop and the handle to allow the mop head to flex.

U.S. Pat. No. 1,832,536 also shows a closed helical coil spring for providing a resilient connection between the mop and the handle to allow the mop head to flex to accommodate various positions of the handle with respect to the mop.

U.S. Pat. No. 1,946,158 also shows a closed helical coil spring for providing a resilient connection between the mop and the handle to allow the mop head to flex if the mop should inadvertently contact any solid body.

SUMMARY OF THE INVENTION

Briefly, the invention comprises a paint roller frame having a wire coil female thread for attaching a plurality of different handles thereto in a firm but yieldable relationship. The wire coil female thread is formed directly in the wire frame that is used to support the roller. The wire coil female thread locks into the handle to prevent accidental loosening and permit the user to completely replace the handle of the paint roller. The individual turns of the wire coil female thread are also locked between the roots and crowns of the rigid male threads to limit the freedom of movement of the flexible wire coil to provide a firm but yieldable connection between the frame and the handle. The helical wire coil female thread permits direct transfer of pressure to the paint roller directly from the extension handle rather than through a permanent handle mounted on the wire frame. An extension member on the wire paint roller frame enables a user to lock or unlock a handle from the wire paint roller frame.

DESCRIPTION OF THE PREFERRED EMBODIMENT

Figure 1:
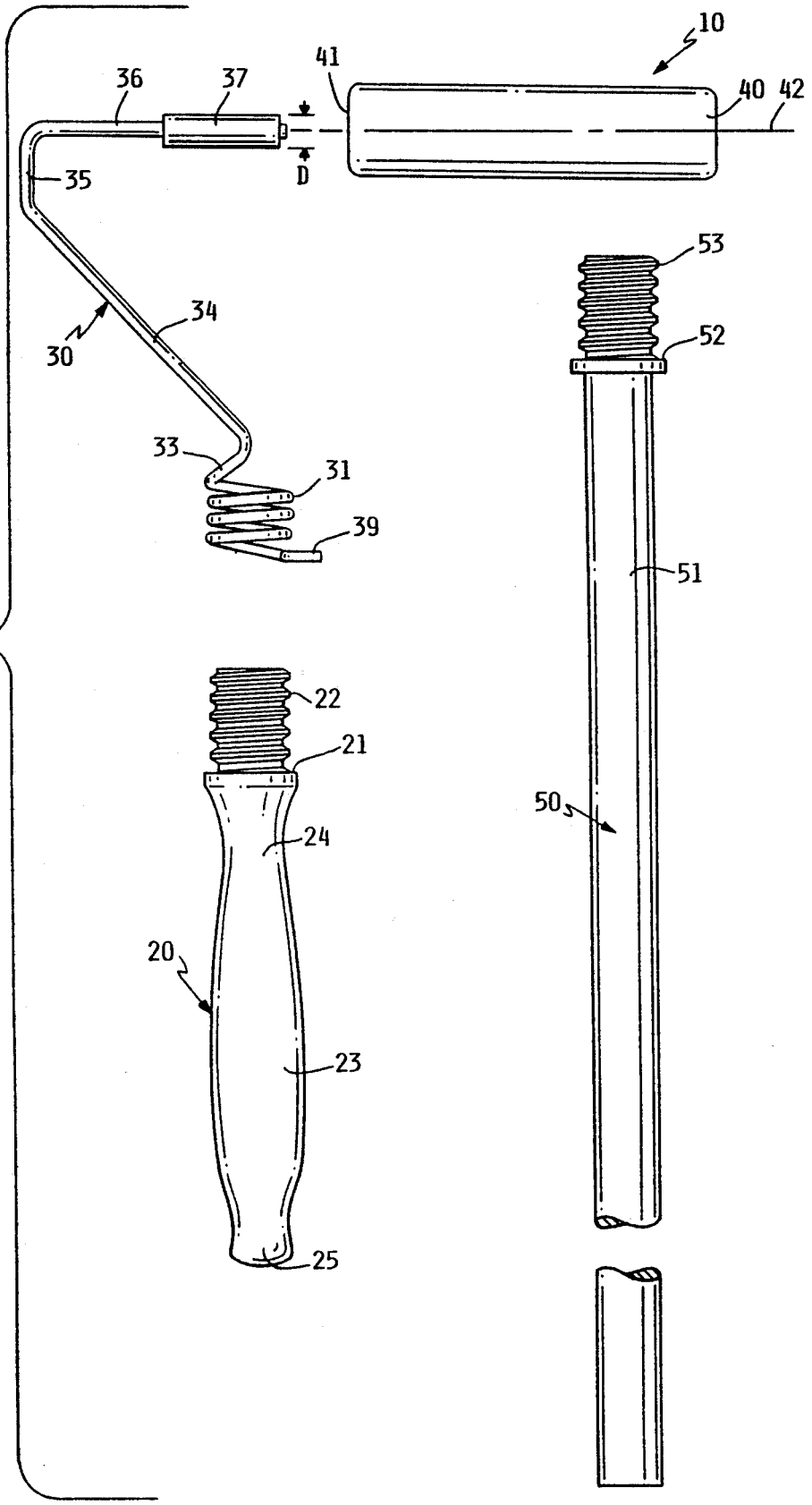
FIG. 1 shows a paint roller kit comprising a frame, a roller, a short handle for close work and an extension handle for painting remote surfaces.

Referring to FIG. 1 reference numeral 10 generally identifies a paint roller applicator kit comprising a paint roller 40, a wire paint roller frame 30, a short handle 20 and an extension handle 50. Roller 40 includes a cylindrical symmetrical opening 41 with an internal bearing (not shown) to permit rotatable mounting of roller 40 about a central axis 42 of wire frame 30.

Figure 8:
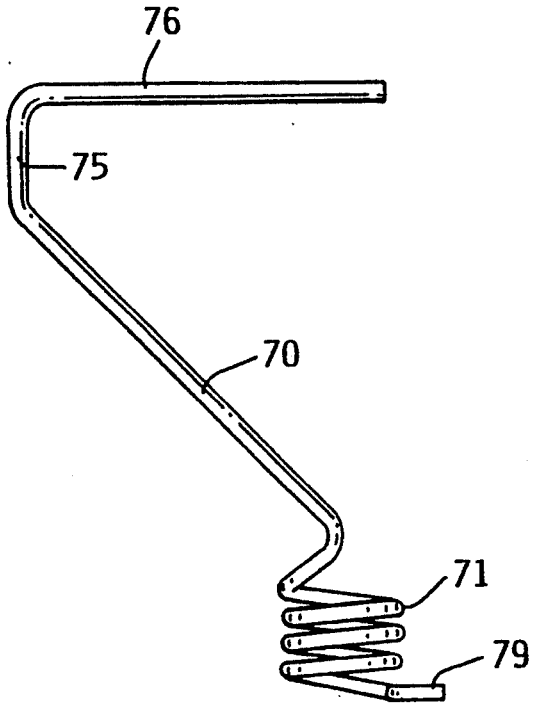
FIG. 8 shows a one piece wire paint roller frame for use in supporting a paint roller.

Wire paint roller frame 30 comprise a helical open wire coil female thread 31 on one end and on the opposite end a cylindrical member 37 for frictionally engaging a bearing housing in roller 40 to hold paint roller 40 in a rollable position. One end of helical wire coil female thread 31 extends upward with a neck 33 that connects to a cross member 34 which connects to a roller shaft 36 through a member 35. The frame 30 comprises a single continuous piece of resilient wire that is formed into a support for roller 40. An enlarged cylindrical sleeve 37 of diameter D is mounted on shaft 36 to accommodate the bearing in the paint roller. That is, the paint roller frame 30 may have a different diameter than the bearing in the paint roller. To accommodate different diameter bearings sleeve 37 can be frictionally mounted on shaft 36 to provide the proper outside diameter D for frictionally engaging a bearing housing in a paint roller. FIG. 8 shows an alternate embodiment in which the wire paint roller frame is of the same diameter throughout the frame.

Reference numeral 20 identifies a short handle comprising a rigid male thread 22 for threading into the female thread formed by open helical wire coil female thread 31. Handle 20 includes a shoulder 21 for lockingly engaging one end of wire coil female thread 31. Handle 20 generally conforms to the user hand with a neck 24, a palm grasping portion 23 and an end 25 for abutting against the users hand.

Reference numeral 50 identifies the extension handle that includes a cylindrical pole 51 having a shoulder 52 with rigid male threads 53 for engaging helical wire coil female thread 31. Rigid male threads 53 and 22 are the same size so that either handle 50 or handle 20 can be used with paint roller wire frame 30.

Figure 2:
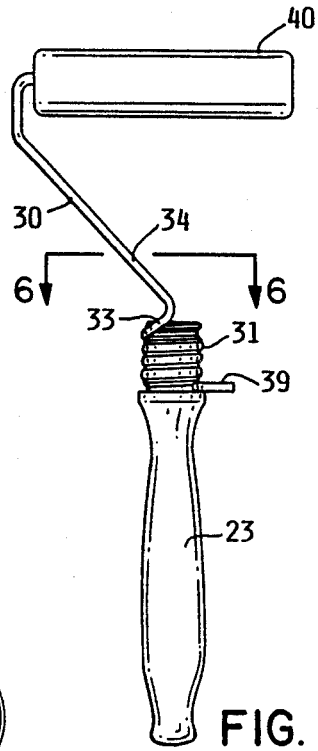
FIG. 2 shows a paint roller with a short handle.
Figure 4:
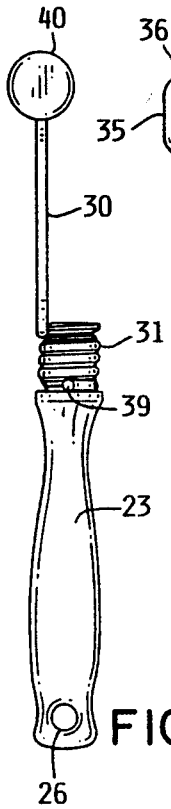
FIG. 4 shows a side view of the paint roller of FIG. 2.
Figure 3:
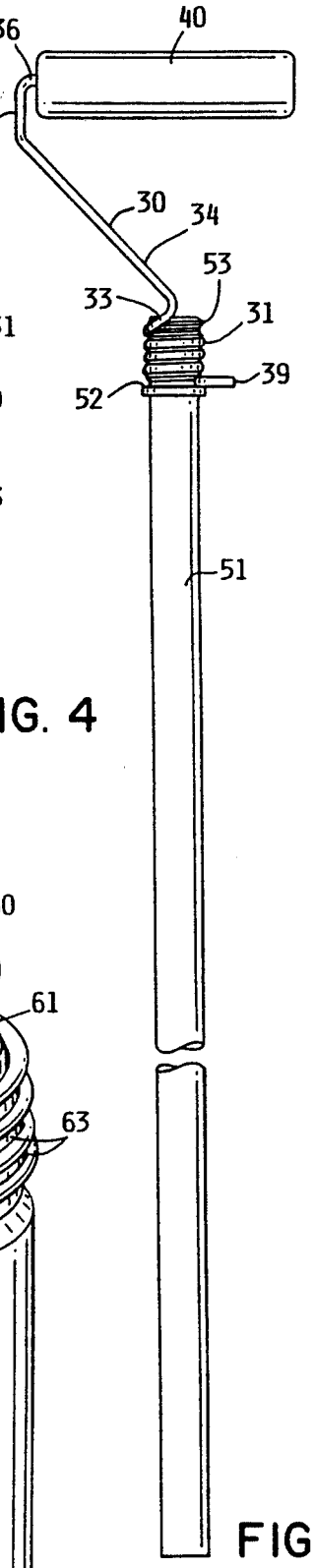
FIG. 3 shows a paint roller with an extension handle replacing the short handle.

FIG. 2 shows a front view of paint roller frame 30 mounted on rigid male threads 22 of handle 23. Similarly, FIG. 4 shows a side view of the paint roller frame 30 mounted on threads 22 of handle 23. FIG. 3 shows a front view of the paint roller frame 30 mounted on rigid male threads 23 of extension handle 51. Extending outward form paint roller frame 30 is an extension member 39 that enables a user to unlock a handle from the wire paint roller frame once a handle is locked in the paint roller frame.

Figure 5:
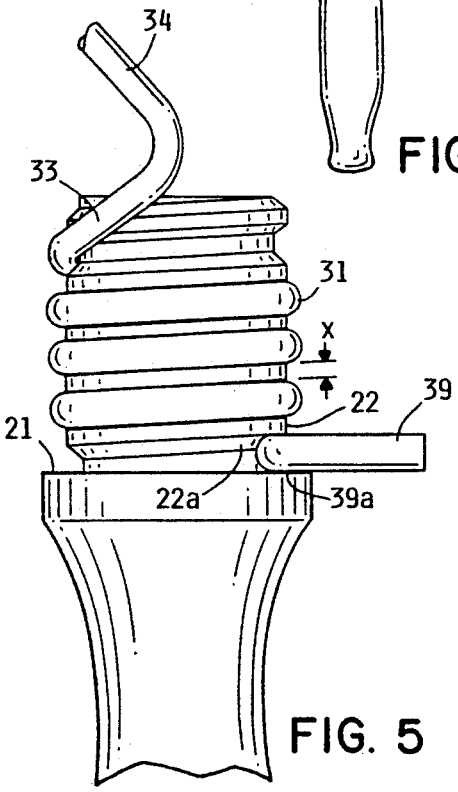
FIG. 5 shows a close up of the locking mechanism for locking the coil on the handle.

FIG. 5 shows an enlarged view of the locking mechanisms created by wire coil female thread 31 and shoulder 21 on handle 23. The wire coil female thread comprises an open helical or spiral wire coil 31 with the uniform spacing between each coil turn indicated by the dimension x. The present invention with the wire coil female thread 31 provides an improved one piece paint roller frame formed from a resilient wire. One end of the paint roller frame 30 is formed into an open helical wire coil 31 having a female thread configuration that allows the user to easily remove or attach a paint roller handle to the paint roller frame, yet provides a firm but yieldable connection between the paint roller handle and the paint roller frame so that pressure on the handle can be applied directly to the paint roller frame 30 rather than through a socket housing in a permanent paint roller handle.

FIG. 5 also shows how the open wire coil female thread 31 of the present invention minimizes the inherent spring effect produced by forming a wire coil from a resilient metal wire. To minimize the spring effect we provide the wire coil female thread 31 with equal or less turns then the rigid male threads 22. The result is that all the individual turns of the wire coil female thread 31 are locked between the roots **22*a* and crowns of the rigid male threads 22 to limit the freedom of movement of the wire coil. Locking the female threads 31 formed from a resilient wire into rigid male threads 22 on the handle provides an interlocking firm connection between the frame and the handle that restrains movement of the wire coil female thread 31 and negates the spring effect inherently produced by an open wire coil. Consequently, the resilient aspect of a wire coil 31 formed from a resiliently wire is substantially destroyed by locking the roots and crowns of the wire coil female thread 31 into the roots and crowns of rigid male thread 22. However, since the wire coil female thread 31 is restrained from movement only by rigid male thread 22, which is located on the inside of female thread 31, the connection between the handle and the frame retains a certain amount of resiliency or yieldability since the female wire coil thread can flex outwardly. Consequently, if undue pressure is accidently applied to the extension handle the wire coil female threads 31**, which are located on the rigid male threads, can flex slightly outward and away from the rigid male thread in response to the force. The result is is that one can distribute the handle forces to the frame and thus minimize the chances of breaking the connection portion between the frame and the handle.

Located at the end of the wire coil female thread is extension member 39 that is bent backwards and extends radially outward from the wire coil. In operation the wire coil female thread 31 is rotated with respect handle 23 until wire extension member 39 is frictionally held by thread root surface **22*a* and shoulder top surface 39*a*. That is by wedging or turning the wire coil female thread until member 39 binds or engages the threads in an offset arrangement causes the male thread 22 and the wire coil female thread to lock with each other to prevent wire coil female thread 31 from working loose. If a user wants to remove wire paint roller frame 30 from a handle the user pushes on member 39 to force member 39 away from the locking engagement with threads 22. This action relieves the binding forces on the wire coil female thread and allows a user to unscrew the wire coil female thread 31**.

FIG. 5 illustrates the relationship between the number of coils on the female thread and the number of rigid male threads on the handle. If the coils on the female thread are equal or less than the number of rigid male threads the inherent flexing of the coil is eliminated since coil 31 is completely supported by rigid male threads 22. Thus the flex in the wire paint frame is a result of the stiffness of the wire and not increased by including a wire coil as the connecting link.

FIG. 5 also illustrates the root 22*a* of rigid male threads 22 which extend outward sufficiently far so as to longitudinally and radially support the wire coil female thread in the thread cavities of the rigid male threads 22. That is, the individual loops of the wire coil female thread 31 are prevented from axial movement by the spiral cavity formed in threads 22 on the handle 23.

Figure 6:
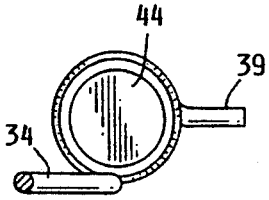
FIG. 6 shows a top view of the helical coil for attaching the paint roller frame to a handle.

FIG. 6 shows that the paint roller frame 34 extends substantially tangentially off the handle while the extension member 39 extends radially outward from coil 31.

Figure 7:
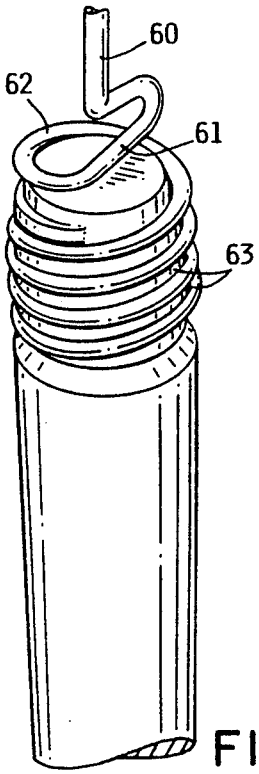
FIG. 7 shows an alternate embodiment of a locking mechanism for holding the extension pole on the paint roller frame.

FIG. 7 shows an alternate embodiment of a locking coil that includes a member 61 that locks onto the top of handle 65 through a wire coil female thread 62 that engages threads 63. In this embodiment a plier can be used to free the wire coil female thread from the handle 65.

We claim:

1. A paint roller kit having interchangeable handles comprising:

a roller having a central axis and means for rotatably supporting said roller about said central axis;

a wire frame, said wire frame formed from a resilient wire, said wire frame having a first end, a second end and an elongated intermediate member, said first end having a member for engaging said means for rotatably supporting said roller about said central axis to thereby hold said roller on said first end of said wire frame so that said roller can be rotated about the central axis, said second end of said wire frame having a female thread formed in the wire to thereby provide an open coil female thread having a plurality of coils providing a spring effect, said intermediate member extending substantially tangentially to said open coil female thread; and a first handle, said first handle having a first end and a second end, said first end of said handle having a rigid male thread having roots and crowns for lockingly engaging all of said plurality of coils of said open coil female thread in said wire frame to negate the spring effect of said female coil thread and provide an interlocking firm but yieldable connection between the open coil female thread and the male thread that allows the coils of the female thread to yield without breaking if undue pressure is applied to said first handle and to permit a user to thread said first handle into said wire frame to thereby produce a paint roller applicator, said second end of said first handle free of any female threads so that if a user wants to change said first handle in said paint roller applicator the user must remove said first handle from said female thread in said wire frame and replace said first handle with another handle having a rigid male thread for threadingly engaging said female thread in said wire frame.

2. The paint roller kit of claim 1 including a second handle, said second handle being longer than said first handle to permit a user to replace said first handle with said second handle so that a user can paint areas remote from the user.

3. The paint roller kit of claim 1 wherein said first handle includes a shoulder for engaging said female thread to thereby lockingly engage said rigid male thread of said first handle with said female thread.

4. The paint roller of claim 1 wherein said wire has a first diameter at one end and a second diameter at said second end with said first diameter being larger than said second diameter.

5. The wire frame of claim 1 including a member extending radially outward from said female thread to permit a user to unlock said wire coil from said first handle to assist a user in unscrewing said wire frame from said first handle.

6. The paint roller kit of claim 1 wherein said female thread on said wires has at least three coils to thereby engage at least three coils of a rigid male thread.

7. The paint roller kit of claim 1 wherein said first end of said wire frame has a first axis and said female thread has a central axis with the central axis of said female thread substantially perpendicular to said first axis.

8. The paint roller kit of claim 1 wherein said handle is wood or plastic and said frame is a metal.

9. A paint roller for on site assembly comprising:

a roller having a central axis and means for rotatably supporting said roller about said central axis;

a frame, said frame having a first end and a second end, said first end of said frame including means to mount said roller on said first end of said frame to thereby rotatably support said roller about said central axis, said second end having an open coil female thread, said open coil female thread having a plurality of turns providing a spring effect, said frame comprising a cylindrical wire, said cylindrical wire having an inherent resiliency and sufficient rigidity so that when said roller is rotatably mounted on said first end said wire supports said paint roller in an extended position to permit a user to apply paint to a surface with a back and forth motion with said roller, said open coil female thread providing an inherent spring effect; and a handle, said handle having a first end and a second end, said first end of said handle having a rigid male thread having roots and crowns for engaging and locking said turns of said open coil female thread in said wire frame to provide a firm but yieldable connection to said rigid male thread to restrain flexing movement of said open coil female thread and thereby negate the inherent spring effect of said open coil female thread between said handle and said frame yet permit an individual turn of said open coil female thread to yield with respect to said male thread when excessive pressure is applied to said handle to thereby prevent breaking of said open coil female thread, said second end of said handle free of any female threads so that if a user wants to change handles in said paint roller applicator the user must remove said handle from said female threads in said wire frame and replace said handle with a second handle having a male thread for threadingly engaging said open coil female thread in said wire frame.

10. A paint roller frame comprising:

a resilient wire, said resilient wire forming a wire paint roller frame, said frame having a first end, a second end and an elongated intermediate member, said first end of said frame including a straight cylindrical shaft having a central axis to enable a user to rotatable mount a roller on said first end of said frame, said second end of said frame having a helical coil forming a female thread, said female thread formed directly from the wire to thereby provide an open coil female thread having a plurality of turns for threadingly and lockingly engaging a rigid male thread to provide a firm but yieldable connection by preventing flexing of the open coil female thread when pressure is applied to the rigid male thread engaging the female thread, said female thread located on said second end of said frame, said frame comprising a one piece cylindrical wire, said open coil female thread on said cylindrical wire when engaged with said rigid male thread forming the firm but yieldable connection so that when a roller is rotatably mounted on said first end and a handle is mounted in said helical coil on said second end said frame supports said roller in an extended position to permit a user to apply paint to a surface with a back and forth motion with said frame.

* * * * *